US008256434B2

(12) United States Patent
Watters et al.

(10) Patent No.: US 8,256,434 B2
(45) Date of Patent: Sep. 4, 2012

(54) CIGARETTE FILTER

(75) Inventors: Paul Watters, Wigton (GB); Colin Marshall, Wigton (GB)

(73) Assignee: Innovia Films Limited, Wigton, Cumbria (GB)

( * ) Notice: Subject to any disclaimer, the term of this patent is extended or adjusted under 35 U.S.C. 154(b) by 0 days.

(21) Appl. No.: 12/854,233

(22) Filed: Aug. 11, 2010

(65) Prior Publication Data

US 2011/0100386 A1 May 5, 2011

(30) Foreign Application Priority Data

Aug. 14, 2009 (GB) ..... 0914250.6
Jul. 16, 2010 (GB) ..... 1011993.1

(51) Int. Cl.
*A24B 15/28* (2006.01)

(52) U.S. Cl. ..... 131/332; 131/331; 523/100

(58) Field of Classification Search ..... None
See application file for complete search history.

(56) References Cited

U.S. PATENT DOCUMENTS

| | | | | |
|---|---|---|---|---|
| 3,639,324 | A * | 2/1972 | Owens et al. | 523/100 |
| 7,094,465 | B2 * | 8/2006 | Peiffer et al. | 428/331 |
| 2002/0198215 | A1 * | 12/2002 | Tavares et al. | 514/252.17 |
| 2003/0178039 | A1 | 9/2003 | White et al. | |
| 2009/0288669 | A1 * | 11/2009 | Hutchens | 131/274 |

* cited by examiner

*Primary Examiner* — Richard Crispino
*Assistant Examiner* — Phu Nguyen
(74) *Attorney, Agent, or Firm* — Ping Wang; Andrews Kurth LLP

(57) ABSTRACT

The present invention concerns an at least partially transparent cigarette filter tipping film comprising a biodegradable substrate, and softener in an amount of less than 25% by weight of the biodegradable substrate, and a cigarette filter comprising a filtration material encased in a cylinder of the said tipping film.

13 Claims, No Drawings

CIGARETTE FILTER

FIELD

The present application concerns a cigarette filter having a filtration material and a tipping film, more particularly a biodegradable tipping film with excellent physical properties, in particular with regard to elongation, tensile strength and shrinkage, but also as far as flatness and tube/curl are concerned.

BACKGROUND

There is a current demand for cigarette tipping films which are transparent, allowing the smoker to view the effectiveness of the filter material enclosed within the tipping film.

Certain biodegradable substrates have been considered for use as cigarette tipping films. However, because of stringent demands in the tobacco industry with regard to the chemical make up of tipping films, and also with regard to their physical properties, there is a need to provide an improved form of tipping film which is substantially free from certain specified contaminants and which has excellent properties as far as elongation, tensile strength, shrinkage, flatness and tube/curl are concerned. In particular, the mechanical tolerances of any such film must be carefully controlled in order to allow the film satisfactorily to be deployed in the machinery used by the tobacco industry to wrap tipping papers around filter tips. Because of the relatively small size of the unit film, and the necessity for it to be tightly and neatly wound on the filter, it has proved difficult to develop a filmic material, particularly one with other desirable qualities such as biodegradability and transparency to meet these criteria.

The present invention seeks to address these issues.

SUMMARY

One aspect of the present application is directed to a cigarette filter tipping film, comprising a biodegradable substrate; and softener in an amount of less than 25% by weight of the biodegradable substrate, wherein the tipping film is at least partly transparent.

Another aspect of the present application directs to cigarette filter tipping film, comprising a biodegradable substrate; and softener in an amount of less than 25% by weight of the biodegradable substrate, wherein the tipping film exhibiting one or more of the properties selected from (a) an elongation in the machine direction of less than 15%; (b) a tensile strength in the machine direction of more than 140 MPa; (c) a Young's Modulus in the machine direction of more than 4000 MPa; (d) a shrinkage under tropical conditions in the machine and/or transverse; (e) directions of less than 5%; (f) a Haze of less than 2.15; and/or (g) a Gloss of more than 98.

DETAILED DESCRIPTION

According to the present application, there is provided an at least partially transparent cigarette filter tipping film comprising a biodegradable substrate, and softener in an amount of less than 25% by weight of the biodegradable substrate.

The biodegradable substrate is selected from biodegradable substrates, PLA substrates, starch based polymers, hydroxyalkanoates and other biopolymers, but is preferably a cellulosic substrate.

The application also provides a cigarette filter comprising a filtration material encased in a cylinder of aforesaid tipping film.

Preferably the tipping film is at least mostly transparent so that the filtration material can be viewed through the tipping film.

Preferably the softener is present in the tipping film in an amount of less than 24% by weight, more preferably less than 21% by weight and most preferably less than 18% by weight of the biodegradable substrate.

The softener may be selected from any suitable material, but is preferably selected from glycerol, propane-1,2-diol, and any other suitable softener selected from the German Tobacco Ordinance (TVO) list, the contents of which are hereby incorporated by reference, and an English translation of which is reproduced in Appendix 1, Part A hereto, and combinations of two or more thereof.

The tipping film itself will generally be cast and then wound onto a reel prior to eventual unwinding and slitting for use as a cigarette tipping film. In order to allow the film to be wound onto a reel without sticking to itself, the substrate is preferably provided with an antiblock/winding aid additive. When present the antiblock/winding aid additive is preferably provided in an amount of less than about 0.5%, more preferably less than about 0.4, even more preferably less than about 0.3 and most preferably less than about 0.2% by weight of the biodegradable substrate.

The antiblock/winding aid when present may be selected from any suitable material, but is preferably selected from amorphous silica, polyethylene glycol, and any other suitable antiblock/winding agent selected from the TVO list, and combinations of two or more thereof.

It was surprisingly found that by careful selection of the quantity of softening agent in the tipping film, and in preferred embodiments of the invention of the type of softening agent in the tipping film, certain problems exhibited in the art with reference to conventional biodegradable substrates can be avoided. For example, certain conventional biodegradable substrates which would otherwise be suitable as tipping films have been found to be too easily elongated—a property which causes problems in the machinery commonly used in the tobacco industry for rolling tipping materials around cigarette filters. Certain conventional biodegradable substrates have been found to be insufficiently flat, to exhibit unacceptable levels of curl, to lack sufficient tensile strength and/or to be too elastic, to be to susceptible to shrinkage and/or to have inadequate optical properties.

The tipping films of the invention preferably exhibit an elongation in the machine direction of less than 15%, more preferably less than 13% and most preferably less than 11% when subjected to standard testing conditions referred to herein in the Examples.

The tipping films of the invention exhibit excellent properties with regard to flatness and tube/curl. Preferably the tipping films of the invention exhibit a flatness of less than about 4 cm, preferably less than 3 cm and exhibit a tube/curl of less than 45°, preferably 0° once wound (Flatness is measured by placing a 6 m length of cast film on a flatness table and pulling the film until tight. Flatness is measured by using graduated rulers, the results are recorded as, Flatness (cm)=Centre reading (cm)—Edge reading (cm). Tube/curl is measured by hanging approx. 600 mm of cast film from a suspended mill roll, strips are cut in the machine direction 100 mm apart across the width of the roll, film is left to stand for 15-20 seconds, visual checks for tube and curl are made and results are recorded in degrees).

It may also be important to maintain the tensile strength of the tipping film in order to allow satisfactory machinability of the film. Preferably the tipping films of the invention exhibit a tensile strength in the machine direction of more than 140 MPa, more preferably more than 150 MPa and most preferably more than 155 MPa when subjected to standard testing conditions referred to herein in the Examples.

It may also be important to maintain the elasticity of the tipping film in order to allow satisfactory machinability of the film. Preferably the tipping films of the invention exhibit a Young's Modulus in the machine direction of more than 4000 MPa, more preferably more than 5000 MPa and most preferably more than 5500 MPa when subjected to standard testing conditions referred to herein in the Examples.

It may also be important to ensure that the tipping films of the invention do not exhibit too high a shrinkage, in order to allow satisfactory machinability of the film. Preferably the tipping films of the invention exhibit a shrinkage under tropical conditions in the machine and/or transverse directions of less than 5%, more preferably less than 4% and most preferably less than 3.75% when subjected to standard testing conditions referred to herein in the Examples.

It may also be important to maintain the optical properties of the tipping film. Preferably the tipping films of the invention exhibit a Haze of less than 2.15, more preferably less than 2.10 and most preferably less than 2.05 when subjected to standard testing conditions referred to herein in the Examples. Preferably the tipping films of the invention exhibit a Gloss of more than 98, more preferably more than 99 and most preferably more than 100, when subjected to standard testing conditions referred to herein in the Examples.

EXAMPLES

A 28 μm film of regenerated cellulose was cast from solution under standard conditions and in the presence of a glycerol softener in an amount of approximately 12% by weight and an amorphous silica antiblock in an amount of approximately 0.1% by weight. Any other additives and components of the film were present in standard quantities, and selected from the TVO list (Appendix 1, Part A).

Five samples of the film, and a comparative sample containing approximately 20% by weight softener (25% softener by weight of cellulosic substrate) were subjected to physical testing in accordance with BS2782-3, as amended by BS1133 to determine Secant 1%, Tensile Strength, Elongation, Load and Youngs Modulus.

The results are presented below in Table 1:

TABLE 1

| | | Machine Direction | | | | | Transverse Direction | | | | |
|---|---|---|---|---|---|---|---|---|---|---|---|
| EG | code | Secant 1% (MPa) | Tensile Strength (MPa) | Elongation % | Load (N) | Youngs Modulus (MPa) | Secant 1% (MPa) | Tensile Strength (MPa) | Elongation % | Load (N) | Youngs Modulus (MPa) |
| 1 | 252892 | 7010 | 163 | 7.036 | 105.8 | 6782 | 5870 | 114 | 11.5 | 74.07 | 4186 |
| 2 | 252904 | 7470 | 179 | 12.48 | 120.8 | 7095 | 4190 | 104 | 31.8 | 70.14 | 4175 |
| 3 | 252908 | 7550 | 164 | 8.913 | 111 | 7523 | 3980 | 106 | 35.48 | 71.27 | 3952 |
| 4 | 252922 | 6830 | 175 | 12.75 | 118.3 | 6404 | 4650 | 109 | 39.75 | 73.73 | 4477 |
| 5 | 252930 | 7420 | 181 | 14.02 | 122.3 | 7070 | 7870 | 179 | 12 | 120.6 | 7275 |
| | Av. | 6703 | 168 | 10.22 | 112.41 | 6471 | 5100 | 117 | 24.65 | 78.29 | 4670 |
| 6 | comp. | 5160 | 153 | 19.47 | 101.20 | 4929 | 2010 | 65 | 46.64 | 43.26 | 2020 |

It will be seen that the films of Examples 1 to 5 exhibit considerably less elongation than the comparative example, a property which facilitates the compatibility of such films with conventional industrial plant for the manufacture of cigarette tipping films.

The films were further subjected to Coefficient of Friction (COF) measurement in accordance with ASTMD1894. The results are shown below in Table 2:

TABLE 2

| | A-A | |
|---|---|---|
| Sample | Static | Dynamic |
| 1 | 0.499 | 0.415 |
| 2 | 0.605 | 0.473 |
| 3 | 0.557 | 0.463 |
| 4 | 0.589 | 0.497 |
| 5 | 0.565 | 0.483 |
| 6 Comparative | 0.603 | 0.493 |

It will be seen that the films of Examples 1 to 5 exhibit acceptable COF properties in relation to the comparative example.

The films were further subjected to optical characterization as follows:

Haze was measured in accordance with ASTMD1003

Gloss was measured in accordance with ASTM D2457

The results are shown below in Tables 3a and 3b:

TABLE 3a

| | Haze | | | |
|---|---|---|---|---|
| Sample | 1 | 2 | 3 | Ave |
| 1 | 1.76 | 1.73 | 1.81 | 1.77 |
| 2 | 1.91 | 2.04 | 2.04 | 2.00 |
| 3 | 1.83 | 1.92 | 1.83 | 1.86 |
| 4 | 1.88 | 2.04 | 1.93 | 1.95 |
| 5 | 1.99 | 2.08 | 1.98 | 2.02 |
| 6 Comp. | 2.15 | 2.16 | 2.19 | 2.17 |

TABLE 3b

| Gloss | | | |
|---|---|---|---|
| 1 | 2 | 3 | Ave |
| 101.3 | 106.2 | 102.5 | 103.3 |
| 106.8 | 106.0 | 106.0 | 106.3 |

TABLE 3b-continued

| Gloss | | | |
|---|---|---|---|
| 1 | 2 | 3 | Ave |
| 103.6 | 103.1 | 106.0 | 104.2 |
| 104.8 | 104.7 | 106.6 | 105.4 |
| 103.3 | 104.6 | 101.8 | 103.2 |
| 97.7 | 98.1 | 98.1 | 98.0 |

It will be seen that the films of Examples 1 to 5 exhibit improved optical properties in relation to the comparative example.

The shrinkage properties of the films were investigated under tropical conditions (90% relative humidity at 38° C.), and the results are shown in Table 4:

TABLE 4

| | | 0 | 1 | Results | 3 | Results | 6 | Results | 10 | Results | 14 | Results | 28 | Results |
|---|---|---|---|---|---|---|---|---|---|---|---|---|---|---|
| 1 | MD1 | 107.00 | 104.52 | −2.32 | 104.87 | −1.99 | 104.78 | −2.07 | 103.01 | −3.73 | 103.09 | −3.65 | 103.80 | −2.99 |
| | MD2 | 106.67 | 104.45 | −2.08 | 104.49 | −2.04 | 104.06 | −2.45 | 103.04 | −3.40 | 103.26 | −3.20 | 103.56 | −2.92 |
| | MD3 | 106.45 | 103.95 | −2.35 | 104.14 | −2.17 | 103.51 | −2.76 | 102.87 | −3.36 | 102.89 | −3.34 | 102.87 | −3.36 |
| | TD1 | 106.43 | 104.76 | −1.57 | 104.28 | −2.02 | 104.49 | −1.82 | 103.82 | −2.45 | 103.79 | −2.48 | 104.19 | −2.10 |
| | TD2 | 105.93 | 104.58 | −1.27 | 104.12 | −1.71 | 104.10 | −1.73 | 103.33 | −2.45 | 103.54 | −2.26 | 103.72 | −2.09 |
| | TD3 | 105.64 | 104.07 | −1.49 | 103.77 | −1.77 | 103.68 | −1.86 | 103.00 | −2.50 | 103.24 | −2.27 | 102.68 | −2.80 |
| Ave MD | | 0.00 | | −2.25 | | −2.07 | | −2.43 | | −3.50 | | −3.40 | | −3.09 |
| Ave TD | | 0.00 | | −1.44 | | −1.83 | | −1.80 | | −2.47 | | −2.34 | | −2.33 |
| 2 | MD1 | 95.06 | 92.49 | −2.70 | 92.62 | −2.57 | 93.16 | −2.00 | 92.76 | −2.42 | 93.01 | −2.16 | 92.46 | −2.74 |
| | MD2 | 95.05 | 92.80 | −2.37 | 92.53 | −2.65 | 93.66 | −1.46 | 92.97 | −2.19 | 93.16 | −1.99 | 93.12 | −2.03 |
| | MD3 | 94.83 | 92.79 | −2.15 | 92.72 | −2.23 | 94.03 | −0.84 | 93.46 | −1.44 | 93.56 | −1.34 | 93.12 | −1.80 |
| | TD1 | 94.84 | 94.20 | −0.67 | 94.07 | −0.81 | 92.73 | −2.22 | 91.88 | −3.12 | 92.05 | −2.94 | 91.69 | −3.32 |
| | TD2 | 95.41 | 94.46 | −1.00 | 94.04 | −1.44 | 92.40 | −3.15 | 91.84 | −3.74 | 92.11 | −3.46 | 91.97 | −3.61 |
| | TD3 | 95.40 | 94.50 | −0.94 | 94.38 | −1.07 | 92.65 | −2.88 | 92.43 | −3.11 | 92.23 | −3.32 | 91.97 | −3.60 |
| Ave MD | | 0.00 | | −2.41 | | −2.48 | | −1.43 | | −2.02 | | −1.83 | | −2.19 |
| Ave TD | | 0.00 | | −0.87 | | −1.11 | | −2.75 | | −3.33 | | −3.24 | | −3.51 |
| 3 | MD1 | 94.66 | 92.42 | −2.37 | 92.17 | −2.63 | 92.24 | −2.56 | 91.37 | −3.48 | 92.27 | −2.52 | 91.74 | −3.08 |
| | MD2 | 94.34 | 92.16 | −2.31 | 92.14 | −2.33 | 92.37 | −2.09 | 91.30 | −3.22 | 91.62 | −2.88 | 91.53 | −2.98 |
| | MD3 | 94.31 | 92.10 | −2.34 | 91.96 | −2.49 | 92.33 | −2.10 | 91.95 | −2.50 | 91.88 | −2.58 | 91.70 | −2.77 |
| | TD1 | 95.07 | 92.61 | −2.59 | 92.72 | −2.47 | 91.97 | −3.26 | 91.88 | −3.36 | 91.63 | −3.62 | 91.97 | −3.26 |
| | TD2 | 94.94 | 92.60 | −2.46 | 92.24 | −2.84 | 91.92 | −3.18 | 91.22 | −3.92 | 91.27 | −3.87 | 91.52 | −3.60 |
| | TD3 | 94.84 | 93.24 | −1.69 | 92.85 | −2.10 | 92.23 | −2.75 | 91.42 | −3.61 | 91.38 | −3.65 | 91.82 | −3.18 |
| Ave MD | | 0.00 | | −2.34 | | −2.48 | | −2.25 | | −3.07 | | −2.66 | | −2.94 |
| Ave TD | | 0.00 | | −2.25 | | −2.47 | | −3.06 | | −3.63 | | −3.71 | | −3.35 |
| 4 | MD1 | 90.06 | 87.63 | −2.70 | 87.60 | −2.73 | 87.15 | −3.23 | 86.96 | −3.44 | 87.23 | −3.14 | 86.99 | −3.41 |
| | MD2 | 89.58 | 87.63 | −2.18 | 87.83 | −1.95 | 87.26 | −2.59 | 87.21 | −2.65 | 87.20 | −2.66 | 87.20 | −2.66 |
| | MD3 | 89.15 | 87.60 | −1.74 | 87.39 | −1.97 | 86.83 | −2.60 | 86.79 | −2.65 | 86.77 | −2.67 | 86.96 | −2.46 |
| | TD1 | 89.12 | 87.49 | −1.83 | 87.65 | −1.65 | 87.16 | −2.20 | 86.67 | −2.75 | 87.19 | −2.17 | 86.66 | −2.76 |
| | TD2 | 89.10 | 88.09 | −1.13 | 87.85 | −1.40 | 87.94 | −1.30 | 87.62 | −1.66 | 87.48 | −1.82 | 87.48 | −1.82 |
| | TD3 | 88.85 | 87.51 | −1.51 | 87.17 | −1.89 | 87.30 | −1.74 | 86.36 | −2.80 | 87.11 | −1.96 | 86.58 | −2.55 |
| Ave MD | | 0.00 | | −2.20 | | −2.22 | | −2.81 | | −2.91 | | −2.82 | | −2.84 |
| Ave TD | | 0.00 | | −1.49 | | −1.65 | | −1.75 | | −2.40 | | −1.98 | | −2.38 |
| 5 | MD1 | 80.79 | 78.79 | −2.48 | 79.13 | −2.05 | 78.77 | −2.50 | 78.19 | −3.22 | 78.31 | −3.07 | 78.49 | −2.85 |
| | MD2 | 80.79 | 79.19 | −1.98 | 79.06 | −2.14 | 78.77 | −2.50 | 78.35 | −3.02 | 78.46 | −2.88 | 78.37 | −3.00 |
| | MD3 | 80.76 | 78.83 | −2.39 | 79.00 | −2.18 | 78.50 | −2.80 | 78.41 | −2.91 | 78.37 | −2.96 | 78.64 | −2.63 |
| | TD1 | 80.88 | 79.83 | −1.30 | 79.80 | −1.34 | 79.60 | −1.58 | 79.20 | −2.08 | 79.37 | −1.87 | 79.26 | −2.00 |
| | TD2 | 81.75 | 79.43 | −2.84 | 79.95 | −2.20 | 79.66 | −2.56 | 78.86 | −3.54 | 79.46 | −2.80 | 79.48 | −2.78 |
| | TD3 | 81.73 | 79.69 | −2.50 | 80.09 | −2.01 | 79.11 | −3.21 | 79.12 | −3.19 | 79.53 | −2.69 | 79.52 | −2.70 |
| Ave MD | | 0.00 | | −2.28 | | −2.13 | | −2.60 | | −3.05 | | −2.97 | | −2.82 |
| Ave TD | | 0.00 | | −2.21 | | −1.85 | | −2.45 | | −2.94 | | −2.45 | | −2.49 |
| 6 | MD1 | 82.57 | 80.02 | −3.09 | 79.50 | −3.72 | 79.38 | −3.86 | 78.55 | −4.87 | 79.22 | −4.06 | 79.10 | −4.20 |
| (comp) | MD2 | 83.04 | 80.68 | −2.84 | 80.64 | −2.89 | 79.99 | −3.67 | 79.95 | −3.72 | 80.13 | −3.50 | 80.13 | −3.50 |
| | MD3 | 83.27 | 81.12 | −2.58 | 81.11 | −2.59 | 80.79 | −2.98 | 80.35 | −3.51 | 80.43 | −3.41 | 80.28 | −3.59 |
| | TD1 | 83.72 | 81.07 | −3.17 | 81.16 | −3.06 | 80.55 | −3.79 | 80.28 | −4.11 | 80.32 | −4.06 | 80.11 | −4.31 |
| | TD2 | 83.93 | 82.01 | −2.29 | 81.59 | −2.79 | 81.27 | −3.17 | 80.56 | −4.02 | 80.68 | −3.87 | 80.37 | −4.24 |
| | TD3 | 84.32 | 81.97 | −2.79 | 82.04 | −2.70 | 81.79 | −3.00 | 81.01 | −3.93 | 81.20 | −3.70 | 81.21 | −3.69 |
| Ave MD | | 0.00 | | −2.84 | | −3.07 | | −3.50 | | −4.03 | | −3.66 | | −3.77 |
| Ave TD | | 0.00 | | −2.75 | | −2.85 | | −3.32 | | −4.02 | | −3.88 | | −4.08 |

It will be seen that the films of Examples 1 to 5 exhibit improved shrinkage properties under tropical conditions in relation to the comparative example.

The shrinkage properties of the films were investigated under fridge conditions, and the results are shown in Table 5:

| | | 0 | 1 | Results | 3 | Results | 6 | Results | 10 | Results | 14 | Results | 28 | Results |
|---|---|---|---|---|---|---|---|---|---|---|---|---|---|---|
| 1 | MD1 | 109.56 | 109.26 | −0.27 | 110.22 | 0.60 | 108.97 | −0.54 | 107.82 | −1.59 | 107.61 | −1.78 | 108.18 | −1.26 |
| | MD2 | 109.53 | 109.17 | −0.33 | 109.95 | 0.38 | 108.86 | −0.61 | 107.89 | −1.50 | 107.42 | −1.93 | 107.20 | −2.13 |
| | MD3 | 109.23 | 109.18 | −0.05 | 109.60 | 0.34 | 109.26 | 0.03 | 107.75 | −1.35 | 107.99 | −1.14 | 107.64 | −1.46 |
| | TD1 | 106.28 | 104.19 | −1.97 | 104.15 | −2.00 | 103.64 | −2.48 | 102.84 | −3.24 | 103.13 | −2.96 | 103.22 | −2.88 |
| | TD2 | 107.31 | 104.87 | −2.27 | 104.80 | −2.34 | 104.17 | −2.93 | 103.87 | −3.21 | 103.20 | −3.83 | 103.93 | −3.15 |
| | TD3 | 107.42 | 105.66 | −1.64 | 105.56 | −1.73 | 105.00 | −2.25 | 103.98 | −3.20 | 103.69 | −3.47 | 103.70 | −3.46 |
| Ave MD | | 0.00 | | −0.22 | | 0.44 | | −0.37 | | −1.48 | | −1.61 | | −1.61 |
| Ave TD | | 0.00 | | −1.96 | | −2.02 | | −2.55 | | −3.21 | | −3.42 | | −3.16 |
| 2 | MD1 | 89.15 | 88.35 | −0.90 | 87.78 | −1.54 | 88.67 | −0.54 | 87.20 | −2.19 | 87.18 | −2.21 | 86.46 | −3.02 |
| | MD2 | 89.42 | 88.04 | −1.54 | 87.74 | −1.88 | 89.48 | 0.07 | 87.19 | −2.49 | 87.13 | −2.56 | 86.82 | −2.91 |
| | MD3 | 89.02 | 88.54 | −0.54 | 88.51 | −0.57 | 89.20 | 0.20 | 88.03 | −1.11 | 87.80 | −1.37 | 87.56 | −1.64 |
| | TD1 | 89.71 | 89.32 | −0.43 | 89.05 | −0.74 | 87.94 | −1.97 | 88.34 | −1.53 | 88.28 | −1.59 | 87.79 | −2.14 |
| | TD2 | 89.66 | 89.77 | 0.12 | 89.36 | −0.33 | 87.65 | −2.24 | 88.34 | −1.47 | 88.61 | −1.17 | 87.60 | −2.30 |
| | TD3 | 89.15 | 89.92 | 0.86 | 89.12 | −0.03 | 88.55 | −0.67 | 88.52 | −0.71 | 88.60 | −0.62 | 87.52 | −1.83 |
| Ave MD | | 0.00 | | −0.99 | | −1.33 | | −0.09 | | −1.93 | | −2.05 | | −2.52 |
| Ave MD | | 0.00 | | 0.18 | | −0.37 | | −1.63 | | −1.24 | | −1.13 | | −2.09 |
| 3 | MD1 | 94.66 | 93.62 | −1.10 | 93.67 | −1.05 | 92.92 | −1.84 | 92.60 | −2.18 | 92.67 | −2.10 | 92.11 | −2.69 |
| | MD2 | 94.34 | 93.24 | −1.17 | 92.76 | −1.67 | 92.59 | −1.85 | 92.20 | −2.27 | 92.02 | −2.46 | 91.79 | −2.70 |
| | MD3 | 94.31 | 93.19 | −1.19 | 92.37 | −2.06 | 92.21 | −2.23 | 91.60 | −2.87 | 91.67 | −2.80 | 91.54 | −2.94 |
| | TD1 | 95.07 | 95.10 | 0.03 | 95.59 | 0.55 | 95.20 | 0.14 | 94.34 | −0.77 | 94.43 | −0.67 | 94.02 | −1.10 |
| | TD2 | 94.94 | 94.91 | −0.03 | 95.51 | 0.60 | 95.28 | 0.36 | 94.32 | −0.65 | 94.31 | −0.66 | 93.64 | −1.37 |
| | TD3 | 94.84 | 95.15 | 0.33 | 95.45 | 0.64 | 95.25 | 0.43 | 94.26 | −0.61 | 94.25 | −0.62 | 93.71 | −1.19 |
| Ave MD | | 0.00 | | −1.15 | | −1.59 | | −1.97 | | −2.44 | | −2.45 | | −2.78 |
| Ave TD | | 0.00 | | 0.11 | | 0.60 | | 0.31 | | −0.68 | | −0.65 | | −1.22 |
| 4 | MD1 | 82.21 | 80.15 | −2.51 | 80.20 | −2.44 | 79.55 | −3.24 | 79.45 | −3.36 | 79.78 | −2.96 | 79.42 | −3.39 |
| | MD2 | 81.97 | 80.75 | −1.49 | 80.74 | −1.50 | 80.55 | −1.73 | 79.93 | −2.49 | 79.83 | −2.61 | 79.81 | −2.64 |
| | MD3 | 82.31 | 81.09 | −1.48 | 81.41 | −1.09 | 81.07 | −1.51 | 80.56 | −2.13 | 80.60 | −2.08 | 80.53 | −2.16 |
| | TD1 | 82.76 | 82.33 | −0.52 | 82.87 | 0.13 | 82.59 | −0.21 | 81.64 | −1.35 | 81.71 | −1.27 | 81.47 | −1.56 |
| | TD2 | 82.79 | 82.55 | −0.29 | 82.59 | −0.24 | 83.02 | 0.28 | 82.19 | −0.72 | 82.03 | −0.92 | 81.99 | −0.97 |
| | TD3 | 82.85 | 83.16 | 0.37 | 83.55 | 0.84 | 83.00 | 0.18 | 82.60 | −0.30 | 81.97 | −1.06 | 81.78 | −1.29 |
| Ave MD | | 0.00 | | −1.83 | | −1.68 | | −2.16 | | −2.66 | | −2.55 | | −2.73 |
| Ave TD | | 0.00 | | −0.15 | | 0.25 | | 0.08 | | −0.79 | | −1.08 | | −1.27 |
| 5 | MD1 | 82.28 | 81.32 | −1.17 | 81.24 | −1.26 | 81.23 | −1.28 | 80.91 | −1.67 | 80.71 | −1.91 | 80.74 | −1.87 |
| | MD2 | 82.70 | 81.99 | −0.86 | 81.54 | −1.40 | 81.21 | −1.80 | 80.90 | −2.18 | 80.86 | −2.22 | 80.69 | −2.43 |
| | MD3 | 81.27 | 81.11 | −0.20 | 81.22 | −0.06 | 81.17 | −0.12 | 80.82 | −0.55 | 80.94 | −0.41 | 80.14 | −1.39 |
| | TD1 | 82.17 | 81.67 | −0.61 | 82.26 | 0.11 | 81.97 | −0.24 | 81.00 | −1.42 | 80.97 | −1.46 | 80.14 | −2.47 |
| | TD2 | 82.16 | 82.16 | 0.00 | 81.94 | −0.27 | 81.93 | −0.28 | 80.76 | −1.70 | 80.73 | −1.74 | 80.75 | −1.72 |
| | TD3 | 81.73 | 81.45 | −0.34 | 82.23 | 0.61 | 81.29 | −0.54 | 80.57 | −1.42 | 80.45 | −1.57 | 80.36 | −1.68 |
| Ave MD | | 0.00 | | −0.74 | | −0.91 | | −1.07 | | −1.47 | | −1.51 | | −1.90 |
| Ave TD | | 0.00 | | −0.32 | | 0.15 | | −0.35 | | −1.52 | | −1.59 | | −1.95 |
| 6 | MD1 | 90.20 | 88.02 | −2.42 | 88.10 | −2.33 | 87.92 | −2.53 | 87.66 | −2.82 | 87.43 | −3.07 | 87.48 | −3.02 |
| (comp) | MD2 | 90.49 | 87.73 | −3.05 | 88.12 | −2.62 | 88.12 | −2.62 | 87.85 | −2.92 | 87.76 | −3.02 | 87.52 | −3.28 |
| | MD3 | 90.56 | 87.86 | −2.98 | 88.14 | −2.67 | 88.40 | −2.39 | 87.86 | −2.98 | 87.74 | −3.11 | 87.51 | −3.37 |
| | TD1 | 90.58 | 89.40 | −1.30 | 90.02 | −0.62 | 90.45 | −0.14 | 89.12 | −1.61 | 89.11 | −1.62 | 88.44 | −2.36 |
| | TD2 | 90.58 | 89.64 | −1.04 | 90.01 | −0.63 | 90.31 | −0.30 | 89.26 | −1.46 | 89.25 | −1.47 | 89.00 | −1.74 |
| | TD3 | 91.08 | 89.80 | −1.41 | 90.42 | −0.72 | 90.39 | −0.76 | 89.21 | −2.05 | 89.31 | −1.94 | 89.01 | −2.27 |
| Ave MD | | 0.00 | | −2.82 | | −2.54 | | −2.51 | | −2.90 | | −3.07 | | −3.22 |
| Ave TD | | 0.00 | | −1.25 | | −0.66 | | −0.40 | | −1.71 | | −1.68 | | −2.13 |

It will be seen that the films of Examples 1 to 5 exhibit improved shrinkage properties under fridge conditions in relation to the comparative example.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the components and steps in any sequence which is effective to meet the objectives there intended, unless the context specifically indicates the contrary.

APPENDIX 1

Regulation Concerning Tobacco and Tobacco Products

Tobacco Regulation of Dec. 20, 1977

(BGBI. I, p. 2831), as amended by the 1st Amending Regulation of 10.26.1982 (BGBI. I, p. 1444), §7 Para. 7 of the Additives Sales Regulation of 7.10.1984 (BGBI. I, p. 897), the 2nd Amending Regulation of 3.21.1986 (BGBI. I, p. 368), §9 of the TabKTHmV Regulation of 10.29.1991 (BGBI. I, p. 2053), Article 1 of the Regulation of 3.8.1996 (BGBI. I, p. 460), Art 21 of the Regulation Concerning the Revision of the Foodstuffs Additives Regulation of 1.29.1998 (BGBI. 1, p.

230) and the 3rd Amending Regulation of 12.8.2003 (BGBI. I, p. 2549)*

* The obligations of EC Directive 98/34 of the European Parliament and Council of Jun. 22, 1998 concerning information procedures in the filed of standards and technical regulations (ABI. EC No. L 204, p. 37), amended by EC Directive 98/48 of the European Parliament and Council of Jul. 20, 1998 (ABI. EC No. L 217, p. 18) have been taken into account.

Based on §9, Para, I, No. 5, §20, Para. 3, §21, Para. 1, No. 1, Letter a and. No. 2, in conjunction with §19, No. 4, Letter b, and §22, Para. 2, Clause 2, of the Foodstuffs and Consumer Products Law of Aug. 15, 1974 (BGBI. I, pp. 1945, 1946), in agreement with the Federal Ministers for Nutrition, Agriculture, Forestry and Economy, and with the consent of the Bundesrat, it is decreed:

§1

(1) The substances listed in Attachment 1 are approved for the commercial manufacture of tobacco products for the purposes specified therein. The approval of the substances listed in Attachment 1 Part B runs until Dec. 31, 2006.

(2) The amounts of the approved substances in the tobacco products must not exceed the maximum amounts specified in Attachment 1.

(3) The approved substances must meet the purity requirements specified in Attachment 1 and the general and applicable special purity requirements of the Additives Sales Regulation.

§2

(1) Odorants and flavorants listed in Attachment 2, No. 1, or obtained from plants or plant parts listed in Attachment 2, No. 2, must not be used for commercial manufacture of tobacco products.

(2) As an exemption from the provision of Para. 1, camphor may be used for the manufacture of snuff in an amount of up to a maximum of 2 grams per 100 grams of product.

(3) The use of decoumarinized tonka beans for snuff (Attachment 1, No. 14, Letter b) remains unchanged.

§3

(1) Aromas containing a solvent listed in Attachment 1, No. 1, Clause 2, must display the wording "Only for the manufacture of tobacco products."

(2) For chewing tobacco, black rolled tobacco and snuff containing a substance listed in Attachment 1, No. 9, the content of these substances must be declared with the wording "with preservative."

(3) For chewing tobacco and black rolled tobacco containing a substance listed in Attachment 1, No. 10, Letter d, and for snuff containing a substance listed in Attachment 1, No. 10, Letter e, the content of these substances must be declared with the wording "with colorant."

(4) For chewing tobacco containing saccharin, the content' of this substance must be declared with the wording "with saccharin sweetener."

(5) For cigars containing a substance listed in Attachment I, No. 10, Letter a, the content of this substance must be declared with the wording "colorant-delustered.

(6) The declarations specified in Para. 1 to 5 must be printed on packages, containers or other coverings in clearly visible, easily legible manner.

(7) With the exception of the cases indicated in Para. 1 to 5, a declaration of the substances allowed under §1 is not required.

§3a deleted

§4

As an exception to §22, Para. 2, Clause 1, No. 2 of the Foodstuffs and Consumer Products Law, cigars may display the declaration "natural colorant" or similar wording indicating the natural condition of the wrapper if they are neither colored nor powdered and have received no other surface treatment.

§5

The following may not be marketed commercially:

1. Cigars made with inserted tobacco sheets having a tobacco content of less than 75% on a dry weight basis.

2. Cigars with a tobacco sheet content exceeding 25% of the weight of the product, less the weight of a mouthpiece; for cigars with an artificial wrapper, this maximum amount is reduced by the weight of the artificial wrapper.

3. Smoking tobacco and cigarettes containing tobacco sheets with a tobacco content of less than 75% on a dry weight basis.

4. Smoking tobacco and cigarettes in which the proportion of tobacco sheets exceeds 25% of the weight of the tobacco mixture.

5. Chemically bleached tobacco products.

6. Colored cigarette tobacco.

7. Colored smoking tobacco, with the exception of black rolled tobacco.

8. Cigars with an artificial wrapper or a wrapper consisting of a tobacco sheet, provided this is declared on the packages by a clearly visible, easily legible statement "with artificial wrapper;" if the weight proportion of tobacco in the wrapper exceeds 50%, the wording "with tobacco-containing artificial wrapper" may be used instead. For cigars with a wrapper consisting of a tobacco sheet, the declaration may be omitted if the weight proportion of tobacco in the tobacco sheet is at least 75% on a dry weight basis.

§5a

It is forbidden to market commercially tobacco products for oral uses other than smoking or chewing.

§6

(1) According to §52, Para. 1, No. 2, of the Foodstuffs and Consumer Products Act, anyone who commercially markets aromas that, in violation of §3, Para. 1 or 6, are not provided with the required statement or it is not displayed in the prescribed manner will be subject to a penalty.

(2) According to §52, Para. 2, No. 1, of the Foodstuffs and Consumer Products Act, anyone will be subject to a penalty who I. in the commercial manufacture of tobacco products intended for sale, uses a) a substance listed in Attachment I in an amount exceeding the maximum permissible amount specified in § I, Para. 2, or in violation of the purity requirements specified in § I, Para. 3, or b) any odorant or flavorant in violation of §2, Para. 1.

2. commercially markets or sells tobacco products for which, in violation of §3, Para. 2 to 5 or 6, the content' of a substance is not declared or is not declared in the manner specified, or commercially markets or sells tobacco products in violation of the prohibition in S 5 or 5a.

(3) Committing an act defined in Para. 1 or 2 out of negligence constitutes a misdemeanor under §53, Para. 1 of the Foodstuffs and Consumer Products Act.

§7 Berlin Clause

§8

(1) This regulation became effective on Jan. 1, 1978.

(2) Tobacco products complying with the stipulations of this Regulation in its version valid on Dec. 18, 2003 may continue to be manufactured until Jun. 18, 2004 and be marketed until stocks have been consumed.

Attachment 1
to §1

Part A

Approved Substances

1. Generally approved as additives for the manufacture of tobacco products:

Aromas meeting the requirements of the Aroma Regulation

Fruits, dried fruits, fruit pulps, fruit juices, concentrated fruit juices and fruit syrups Spices with the exception of the plants and plant parts specified in Attachment 2, No. 2

Licorice root

Licorice

Coffee

Tea and tea-like products

Cocoa and cocoa products

Alcoholic spirits

Wine and liqueur (fortified) wine

Honey

Maple syrup

Sugars as defined under the Sugar Varieties Regulation and other sugar varieties suitable for human consumption, also caramelized Dextrins Molasses Starch, Acid-treated, thin-boiling starch Oxidatively degraded starch Starch phosphate The above starches also in the form of swollen starches Kitchen salt (sodium chloride)

Drinking water

Essences containing the following solvents may also be used for the manufacture of cigarettes, cigars, smoking tobacco and snuff 1,3-butylene glycol (Purity requirements: boiling range at 1013 millibar (760 torr): 207-209° Celsius; refractive index n(20,D)=1.440±0.0005; bromine number by the Klein method=max. 0.1; proportion of reducing substances: as for glycerol, according to the rules of the [German] pharmacopoeia).

2. Humectants:

a) For smoking tobacco, cigars, cigarettes, tobacco sheet and artificial rapper: Glycerol (E 422)

Hydrogenated glucose syrup (Purity requirements: clear, colorless, syrupy solutions containing hydrogenated saccharides derived from glucose syrup and suitable for human consumption; minimum D-sorbitol content: 5% on a dry weight basis.)

1,3-Butylene glycol (Purity requirements: see No. 1)

1,2-Propylene glycol

Triethylene glycol (Purity requirements: specific gravity 20/20° Celsius: 1.124-1.126; boiling range at 1013 millibar (760 torr): 280-290° Celsius; refractive index n (20,D)=1.4550-1.4560; ash content: less than 0.01% by weight; mono ethylene glycol content: less than 0.1% by weight)

Orthophosphohoric acid (E 338)

Glycerophosphoric acid and its sodium, potassium and magnesium compounds up to a maximum total amount of 5% on a dry weight basis b) For chewing tobacco:

Glycerol (E 422) up to 10% on a dry weight basis of the product Hydrogenated glucose syrup (Purity requirements: see letter a)

c) For snuff

Hydrogenated glucose syrup (Purity requirements: see letter a)

Liquid paraffin up to a maximum amount of 25% on a dry weight basis of the product Glycerol (E 422) up to 10% on a dry weight basis of the product 1,2-Propylene glycol 1,3-Butylene glycol (Purity requirements: see No. 1)

3. Glues, Adhesives and Thickening Agents a) For cigars, rope tobacco including black rolled tobacco, tobacco sheets and artificial wrappers, as well as glue for seams, filter coverings, mouthpieces and filter (mouthpiece) coatings for Cigarettes Gelatin Shellac Collodion Cellulose acetate Ethylcellulose, also hydroxyethylated Methylcellulose (E 461), also hydroxyethylated or carboxymethylated Carboxymethylcellulose and its sodium (E 466), potassium, calcium and magnesium compounds, also methylated Carboxymethylstarch with an etherification degree of up to 0.5, dialdehyde starch, prepared from oxidized corn starch with an aldehyde content of at least 90%

Gum arabic (E 4 14)

Agar (E 406)

Alginic acid (E 400)

Sodium alginate (E 401)

Potassium alginate (E 402)

Calcium alginate (E 404)

Tragacanth (E 4 13)

Locust bean meal (E 410)

Guar seed meal (guar gum) (E 412)

Mixtures of:

aa) aqueous dispersions of polyvinyl acetate, also partially hydrolyzed, or of the copolymers of vinyl acetate with vinyl esters of long-chain aliphatic, saturated carboxylic acids having a chain length of $C_{18}$ or with ethylene, and bb) aqueous solutions of polyvinyl alcohol;

glycerol acetate may be added to these mixtures.

b) For tobacco sheet:

Glyoxal in a maximum amount of 2% on a dry weight basis of the product or Melamine formaldehyde resin to a maximum of 2% on a dry weight basis of the product c) For smoking tobacco:

Agar (E 406) Gum arabic (E 414)

d) For chewing tobacco: Gum arabic (E 414) to a maximum amount of 25% on a dry weight basis of the product 4. Whitening and combustion control agents Aluminum hydroxide Aluminum sulfate Aluminum oxide Magnesium oxide Talc Titanium dioxide (E 17 1)

Sodium, potassium, calcium and magnesium compounds of carbonic acid, formic acid, acetic acid, malic acid, citric acid, tartaric acid, lactic acid and nitric acid.

5. Substances for artificial wrapper and cigarette paper

Cellulose containing substances listed in No. 3, Letter a, and in No. 4.

6. Substances for filters of cigarettes, cigarette tips, cigars, cigar tips and tobacco pipes Activated charcoal (Purity requirements: No increase in fluorescence of the solvent after a two-hour extraction with optically pure cyclohexane or benzene in a Soxhlet apparatus.)

Aluminum oxide

Cellulose acetate

Glycerol acetate as binder for cellulose acetate

Silica gel

Magnesium silicate hydrate (Meerschaum)

Polyethylene

Titanium dioxide (EI 17 1) up to 2% of the filter weight

Triethylene glycol diacetate (Purity requirements: Specific gravity at 20/20° Celsius 1.110-1.130, boiling range of the major fraction from 5 to 95 mL of a 100 mL sample at 1013 millibar (760 Torr) 288-3000 Celsius, at 67 millibar (50 Ton) 195-2050 Celsius, color at most weakly yellowish, refractive index n (20,D) 1.438-1.439, viscosity 9.5-9.7 cps at 250 C, triethylene glycol diacetate content at least 97.0%, di-, tetra- and polyethylene glycol diacetate content no more than 1.2%, monoethylene glycol content no more than 0.1%, acids (calculated as acetic acid) not more than 0.05%, maximum water content 0.2%, maximum mineral content 0.01%) Mixtures of a) aqueous dispersions of polyvinyl acetate, also partially hydrolyzed, or of copolymers of vinyl acetate with vinyl esters of long-chain aliphatic saturated carboxylic acids having a chain length up to CIS or with ethylene, and b) aqueous solutions of polyvinyl alcohol as glue for gluing mouthpieces and filter (mouthpiece) covering. Glycerol acetate may be added to these mixtures, Ethyl citrate in cigarette filters (Purity requirements: clear, colorless, viscous liquid, odor-free, [without acid content equivalent to 20.2 0.6 mL of 0.2 N KOH/g; total heavy metal content less than 10 ppm; arsenic less than 3 ppm)

7. Substances for filter wrappers, mouthpieces and filter (mouthpiece) covering:

Paper, cardboard, cellulose

Cork and straw (Purity requirements: must be free of contaminants, particularly Salmonella-free)

Aluminum (E 173)

Aluminum foil, also with protective lacquer (Purity requirements: Taking into account their composition, the lacquer coatings must be dried in such a manner that no volatile fractions, and particularly no solvents, will be transferred from them to the mouthpieces. After application to an appropriate carrier material, 1 $dm^2$ of lacquered surface must not release more than a) 5.0 mg soluble substances b) 1.0 mg phenolic substances c) 0.3 mg formaldehyde d) 1.0 mg zinc ions e) 1.0 mg organically bound nitrogen; no aromatic amines must be detectable during extraction with distilled water at 40° C. within 10 days.)

8. Substances for hot melts for gluing filter wrappers, mouthpieces and filter (mouthpiece) covering:

a) Copolymers of ethylene and vinyl esters of aliphatic saturated mono carboxylic acids with chain lengths $C_2$-$C_{18}$.

(Purity requirements: the melting index according to DIN 53735 must not exceed 500)

b) Hydrogenated polycyclopentadiene resin (Purity requirements: The viscosity must be at least 2,000 cps at 140° C.)

c) Microcrystalline waxes d) Paraffins of Attachment 2 of the Additives Sales Regulation e) Mixed styrene polymers and graft polymers from styrene, alpha-methyl styrene and vinyltoluene.

(Purity requirements: From a 3 $dm^2$ sheet weighing 10 g produced from the product, when heated to 90° C. within 24 hours, not more than 15 mg/dm2 of volatile organic substances shall be released.)

f) Polyisobutylene g) Glycerol and pentaerythritol esters of rosin acid and their hydrogenation products h) 2,6-Ditert.butyl-4-methylphenol (Purity requirements: No more than 0.5% of this substance may be added as an antioxidant during preparation of hot melt from substances listed under letters a to e.)

The substances listed under letters a to g may contain only technically unavoidable residues of monomer starting materials and of any added extractable manufacturing aids.

9. Preservatives, but not for cigars or cigarettes, with the exception of cigarette seam glue and tobacco sheet:

Sorbic acid (E 200), sodium sorbate, potassium sorbate (E 202) and calcium sorbate (E 203) up to 2 grams per kilogram of product on a dry weight basis Benzoic acid (E 210) and sodium benzoate (E 211) up to 5 grams per kilogram of product, calculated as benzoic acid on a dry weight basis Ethyl para-hydroxybenzoate (E 214) and propyl para-hydroxybenzoate (E 216) and their sodium compounds (E 2 15 and E 2 17) up to 5 grams per kilogram of product calculated as benzoic acid on a dry weight basis For tobacco sheets, also thiabendazole (E 233) up to 0.6 grain per kilogram of product on a dry weight basis.

If these preservatives are used in a mixture with one another, the maximum amount indicated for each substance shall be reduced by a percentage equivalent to the cumulative maximum amounts of the other substances contained in the mixture.

10. Colorants a) For cigarette paper and for wrapper, tobacco sheet and artificial wrapper for cigars:

Humic acid and its alkali salts (Purity requirements: These substances must not contain extractable polycyclic aromatic hydrocarbons with three or more rings.)

Buckthorn berry extract, prepared by extracting buckthorn berries (*Rhamnus cartharticus*) with water Logwood extract, prepared by extracting the heart wood of *Haematoxylon campechianum* with water Yellowwood extract, prepared by extracting yellowwood (*Morus tinctoria*) with water Carbo medicinalis vegetabilis [vegetable medicinal carbon] (EIS3)

Brilliant Black BN (E 151)

Cochineal Red A '(EI24)

Fast Red F

Sunset Yellow S (E110)

OrangeGGN

Indigotin I (E132)

Amaranth (EI23)

Tartrazine (E102)

and their aluminum, calcium and magnesium compounds (so-called lakes).

b) For filter wrappers, mouthpieces and filter (mouthpiece) covering for cigars and cigarettes The substances listed under letter a as well as gold foil (E 175)

Gold bronze (copper-zinc alloy with a maximum zinc content of 15%)

Silver bronze (aluminum EI73)

Calcium carbonate (E 170)

Calcium sulfate

Titanium dioxide (E 171), also mixed with mica, where the mica content must not exceed 75% and the colorant mixture must be enveloped by a lacquer binding agent.

Iron oxides and iron hydroxides (yellow, red, brown, black) (E 172)

α-(3-Nitro-5-sulfo-6-hydroxyphenylazo)-acetoacetanilide, 1:1 chromium complex, amine salt, and 4-(3-nitro-5-sulfo-6-hydroxyphenylazo)-1-phenyl-3-methylpyrazolone-5, 1:1 chromium complex, amine salt, for protective lacquer of aluminum foil, up to a total of 150 mg/in$^2$ Coconut shell meal (Purity requirements: must be free of foreign matter, particularly Salmonellae)

c) For glues, adhesives and thickening agents for cigars and smoking tobacco:

Caramel d) For chewing tobacco and black rolled tobacco:

Iron (III) sulfate (ferric sulfate)

(Purity requirements as specified in the [German] pharmacopoeia)

Tannin e) For snuff:

Iron (III) sulfate (ferric sulfate)

(Purity requirements as specified in the [German] pharmacopoeia)

Tannin

Iron oxide, red (E172)

Carbo medicinalis vegetabilis [vegetable medicinal carbon] (EIS3)

Indigotin I (E132)

11. Plasticizers for inks and coatings used for printing on cigarette paper, cigarette filters, filter wraps, mouthpieces and filter (mouthpiece) tipping:

Glycerol acetate

12. Binding agents for printing inks and coatings of filter wrappers, mouthpieces and filter (mouthpiece) tipping:

The substances listed under No. 3, Letter a.

13. Substances for printing on cigarette paper and mouthpiece and filter (mouthpiece) tipping paper:

a) The colorants listed in the Additives Approval Regulation b) The other substances listed above under Number 10, Letters a and b, and Numbers 11 and 12 c) Chrysoin S

Fast Yellow

Archil

Scarlet GN

Ponceau 6 R

Anthraquinone Blue

Black 7984 d) Magnesium carbonate

Aluminum oxide

Unsaturated drying oils, namely linseed oil and wood oil and the stand oils produced from them by heating.

Paraffin, fluid and viscous

Deodorized mineral oil, up to 25 vol. % in the printing ink ready for use (Purity requirements: boiling range at 1013 millibar [760 torr]: 200-350° Celsius, all fragrances and flavorants removed.)

Hydrogenated colophonium (rosin) esters and trihydric or polyhydric alcohols of $C_3$-$C_6$ Phenol-formaldehyde-modified colophonium (rosin)

Xylene-formaldehyde-modified colophonium (rosin)

Acrylic acid-modified and/or maleic acid-modified colophonium (rosin) and their esters with trihydric and polyhydric alcohols of $C_3$-$C_6$ Alkyd resins (polyester from polyhydric alcohols and phthalic acid), also fatty acid modified; fatty acid chain length of $C_6$ and higher Condensation products and etherified condensation products of purified monovalent and polyvalent, optionally alkylated phenols with formaldehyde Xylene-formaldehyde resins and their condensation products with phenol or alkylated phenols Fatty acid-modified phenol-formaldehyde resins, chain length of the fatty acid greater than $C_6$ Drying agents in accordance with German Industry Standard [DIN] 55901; salts and oxides of cobalt, manganese, iron, calcium, zirconium and cerium with naphthenic acids, saturated, primarily tertiary, monocarboxylic acids of $C_9$-$C_{11}$ and 2-ethyl caproic (hexanoic) acid. The dried lacquer film may contain at most 0.2% of cobalt or at most 0.5% of the other drying agents (each based on the metal).

14. Other additives a) For chewing tobacco:

Ammonium chloride

Potassium aluminum sulfate

Calcium chloride

Monopotassium tartrate (tartar)

Saccharin b) For snuff

Yeast

Edible fats and oils

Decoumarinized tonka beans; the coumarin content of the snuff at most 0.003%

Ammonium carbamate (hartshorn salt)

Sodium carbonate:

Potassium carbonate

Calcium carbonate (EI70)

Ammonium chloride

Ammonium hydroxide

Calcium chloride

Calcium hydroxide

Monopotassium tartrate (tartar)

1,3-butylene glycol (For Purity Requirements See Number 1)

c) For white snuff powder:
Ammonium carbamate (hartshorn salt)
Sodium carbonate
Calcium carbonate (E170)
Ammonium chloride
Calcium chloride Part B Provisionally Approved Substances 1. Glues, adhesives and thickening Agents for cigars, rope tobacco including black rolled tobacco, tobacco sheets and artificial wrappers, as well as glue for seams, filter coverings, mouthpieces and filter (mouthpiece) coatings for cigarettes
a) Hydroxypropylstarch (EI440)
b) Acetylated distarch adipate (EI422)
2. Plasticizers for inks and coatings used for printing on cigarette paper, cigarette filters, filter wraps, mouthpieces and filter (mouthpiece) tipping:
a) Acetyl tributyl citrate up to 10% of the product
b) Sucrose acetate isobutyrate up to 10% of the product
Attachment 2 to §12, Para. 1

Prohibited Odorants and Flavorants

1. Agaric acid (agaricine, Acidum agarinicum)
Birch tar oil (oleum Betulae empyreumaticum)
Bitter almond oil containing free or bound hydrocyanic acid
Sassafras oil (oleum Sassafras)
Juniper tar oil (oleum Juniperi empyreumaticum)
Camphor oil
Camphor
Coumarin
Safrole
Thujone
2. Odorants and flavorants produced from:
Woody nightshade (Bittersweet) stems (stipites Dulcamarae)
Camphor wood (lignum Camphorac)
*Polypodium* rootstock (rhizoma Polypodii, rhizoma Filicis dulcis)
Pennyroyal (herb a Pulegii)
*Quassia* wood (bitterwood, lignum Quassiae)
*Quillaia* bark (cortex Quillaiae, soap bark)
Tansy (herba Tanaceti, worm herb)
Rue (herba Rutae)
Sassafras wood (lignurn Sassafras)
Sassafras leaves (folia Sassafras)
Sassafras bark (cortex Sassafras)
Yellow sweet clover (*Melilotus officinalis*)
Tonka beans (semen Toncae)
Vanilla plant (Deer tongue) (*Liatris odoratissima*)
Woodruff (*Asperula odorata*)

What is claimed is:

1. A cigarette filter tipping film, comprising
a biodegradable substrate; and
softener in an amount of less than 25% by weight of the biodegradable substrate,
wherein the tipping film exhibiting one or more of the properties selected from:
(a) an elongation in the machine direction of less than 15%;
(b) a tensile strength in the machine direction of more than 140 MPa;
(c) a Young's Modulus in the machine direction of more than 4000 MPa;
(d) a shrinkage under tropical conditions in the machine and/or transverse directions of less than 5%;
(e) a Haze of less than 2.15; and
(f) a Gloss of more than 98.

2. The cigarette filter tipping film according claim 1, wherein said film is at least partly transparent.

3. The cigarette filter tipping film according to claim 1, wherein the biodegradable substrate is selected from the group consisting of cellulosic substrates, PLA substrates, starch based polymers, and hydroxyalkanoates.

4. The cigarette filter tipping film according to claim 3, wherein the biodegradable substrate is a cellulosic substrate.

5. The cigarette filter tipping film according to claim 1, wherein the softener is present in the tipping film in an amount of less than 24% by weight of the biodegradable substrate.

6. The cigarette filter tipping film according claim 1, wherein the softener is selected from the group consisting of glycerol, propane-1,2-diol, softeners mentioned in the TVO list, and combinations of two or more thereof.

7. The cigarette filter tipping film according to claim 1, comprising an antiblock/winding aid additive.

8. The cigarette filter tipping film according to claim 7, wherein the antiblock/winding aid additive is provided in an amount of less than about 0.5% by weight of the biodegradable substrate.

9. The cigarette filter tipping film according to claim 7, wherein the antiblock/winding aid is selected from amorphous silica, polyethylene glycol, antiblock/winding aids mentioned in the TVO list, and combinations of two or more thereof.

10. A cigarette filter, comprising a filtration material encased in a cylinder of the tipping film of claim 1.

11. A cigarette, comprising a smokable substance and a filter according to claim 10.

12. A cigarette filter plug material, comprising the tipping film of claim 1.

13. The cigarette filter tipping film according to claim 1, wherein the biodegradable substrate is a biopolymer.

* * * * *